US009633606B2

(12) United States Patent
Lee et al.

(10) Patent No.: US 9,633,606 B2
(45) Date of Patent: Apr. 25, 2017

(54) DEVICE FOR DRIVING LIGHT-EMITTING DIODES, LIGHT-EMITTING DEVICE, AND DISPLAY DEVICE

(71) Applicant: Foundation of Soongsil University-Industry Cooperation, Seoul (KR)

(72) Inventors: Ho-Jin Lee, Seoul (KR); Yong-Chan Kim, Soul (KR); Sung-Young Seo, Bucheon-Si (KR)

(73) Assignee: Foundation of Soongsil University-Industry Cooperation, Seoul (KR)

( * ) Notice: Subject to any disclaimer, the term of this patent is extended or adjusted under 35 U.S.C. 154(b) by 136 days.

(21) Appl. No.: 14/571,182

(22) Filed: Dec. 15, 2014

(65) Prior Publication Data

US 2015/0170579 A1 Jun. 18, 2015

Related U.S. Application Data

(63) Continuation of application No. PCT/KR2012/008963, filed on Oct. 29, 2012.

(30) Foreign Application Priority Data

Jun. 13, 2012 (KR) ..... 10-2012-0062957

(51) Int. Cl.
*G09G 3/32* (2016.01)
*G09G 3/3291* (2016.01)
(Continued)

(52) U.S. Cl.
CPC ..... *G09G 3/3291* (2013.01); *G09G 3/3233* (2013.01); *G09G 3/3258* (2013.01);
(Continued)

(58) Field of Classification Search
CPC .... G09G 3/233; G09G 3/3258; G09G 3/3291; G09G 2300/0842; G09G 2310/0262; G09G 2310/067; G09G 2310/0244
See application file for complete search history.

(56) References Cited

U.S. PATENT DOCUMENTS

2007/0024547 A1* 2/2007 Jang ..... G09G 3/3233 345/81
2012/0306374 A1* 12/2012 Lee ..... H05B 33/0896 315/121

FOREIGN PATENT DOCUMENTS

JP 2006120625 A 5/2006
JP 2006276253 A 10/2006
(Continued)

*Primary Examiner* — Ariel Balaoing
(74) *Attorney, Agent, or Firm* — Mintz Levin Cohn Ferris Glovsky and Popeo, P.C.; Kongsik Kim; Jonathon Western

(57) ABSTRACT

A device for driving a light-emitting diode, a light-emitting device, and a display device are disclosed. The disclosed light-emitting diode driving device may include: a first transistor having a first conductive electrode connected with a source voltage terminal and having a second conductive electrode connected with an input terminal of the light-emitting diode; a second transistor having a control electrode connected with the second conductive electrode of the first transistor; and a capacitor having one end connected with a data voltage terminal and having the other end connected with a first node, which is connected with a control electrode of the first transistor and with a first conductive electrode of the second transistor.

4 Claims, 7 Drawing Sheets

(51) Int. Cl.
*G09G 3/3233* (2016.01)
*G09G 3/3258* (2016.01)

(52) U.S. Cl.
CPC ..... *G09G 2300/0417* (2013.01); *G09G 2300/0819* (2013.01); *G09G 2300/0842* (2013.01); *G09G 2310/0262* (2013.01); *G09G 2310/067* (2013.01); *G09G 2310/08* (2013.01); *G09G 2320/0233* (2013.01); *G09G 2320/043* (2013.01)

(56) References Cited

FOREIGN PATENT DOCUMENTS

| | | | |
|---|---|---|---|
| JP | 2006317696 | A | 11/2006 |
| JP | 2008051960 | A | 3/2008 |
| KR | 100599596 | B1 | 7/2006 |
| KR | 100658618 | B1 | 12/2006 |

* cited by examiner

DEVICE FOR DRIVING LIGHT-EMITTING DIODES, LIGHT-EMITTING DEVICE, AND DISPLAY DEVICE

CROSS-REFERENCE TO RELATED APPLICATIONS

This application is a continuation of International Application No. PCT/KR2012/008963, filed on Oct. 29, 2012, which claims priority from Korean Patent Application No. 10-2012-0062957, filed on Jun. 13, 2012. The applications are incorporated herein by reference.

TECHNICAL FIELD

Embodiments of the invention relate to a device for driving a light-emitting diode, as well as a light-emitting device and a display device which include such a device, that can compensate for changes in the threshold voltage occurring in a driving transistor and compensate for deviations in electron mobility that occur during normal processes in a driving transistor.

BACKGROUND ART

Current flat panel display devices can be classified largely into LCD (liquid crystal display) devices, PDP (plasma display panel) devices, and OLED (organic light emitting diode) display devices.

The PDP device has a simple structure and manufacturing process and thus provides an advantage in implementing large screens but, due to the low performance of the elements, may not be suitable for 3D display technology. Also, the active matrix LCD device has a high resolution and allows the implementation of large screens but may not be suitable for 3D displays. Compared with the above, the active matrix OLED display device applied with thin-film transistors (TFT) provides many advantages, such as realistic color reproduction rate, high contrast ratio, thin and light modules, low power consumption, high response speed, wide viewing angle, etc., and is thus gaining interest as a next-generation display device.

An OLED display device may use amorphous silicon thin-film transistors, polycrystalline silicon-based thin-film transistors, and oxide thin-film transistors, etc.

The amorphous silicon thin-film transistor has been considered with high priority in application to large-area active matrix OLED display devices, due to established manufacturing techniques and due to the property of the electron mobility being kept uniform over a large board.

However, the amorphous silicon thin-film transistor may be less desirable in terms of electrical stability due to the inherent properties of the amorphous silicon layer, and the continuous application of the gate bias may result in changes in the threshold voltage, possibly causing problems in driving the OLED pixel circuit within the active matrix.

That is, in order for the luminance of the OLED to be properly adjusted according to the applied data voltage (signal), the amorphous silicon thin-film transistor acting as the driving TFT for driving the OLED may have to operate in the saturation region, but a change in the threshold voltage of an amorphous silicon thin-film transistor may incur a change in the saturation region of the amorphous silicon thin-film transistor. Consequently, the current supplied to the OLED by way of the amorphous silicon thin-film transistor may be reduced, which in turn may lower the luminance of the OLED.

To resolve the problem above, some of the active matrix OLED display devices manufactured more recently use polycrystalline silicon thin-film transistors. The polycrystalline silicon thin-film transistor provides the advantage of enabling integration and allowing the implementation of SOP (system-on-panel) technology. However, the polycrystalline silicon thin-film transistor entails a high manufacturing cost, and the non-uniformity of the elements occurring during processing for a large-board display may generate large deviations in electron mobility.

Active matrix OLED driving circuits can be classified into voltage-driven circuits and current-driven circuits depending on the type of data inputted.

A current-driven circuit can simultaneously compensate for changes in the threshold voltage and for deviations in electron mobility that occur during normal processes, but due to the parasitic capacitance present in the wiring through which data is applied, the charging time can be quite long at low data current levels, creating restraints in the driving frequency.

A voltage-driven circuit allows easier charging and discharging compared to a current-driven circuit, so that it allows a higher operating speed and easier signal connection with the driving circuit of the display. As most driving IC's currently available employ the voltage-driven method, there may be no additional costs needed in manufacturing a driving IC.

However, in the case of the voltage-driven circuit, there have been various research efforts focused on compensating for the threshold voltage of a driving thin-film transistor, there has not been much research performed on compensating for the deviations in electron mobility in a driving thin-film transistor.

SUMMARY

To resolve the problems above, an aspect of the invention is to propose a device for driving a light-emitting diode, as well as a light-emitting device and a display device which include such a device, that can compensate for changes in the threshold voltage occurring in a driving transistor and compensate for deviations in electron mobility that occur during normal processes in a driving transistor.

To achieve the objective above, an embodiment of the invention provides a device for driving a light-emitting diode that includes: a first transistor having a first conductive electrode connected with a source voltage terminal and having a second conductive electrode connected with an input terminal of the light-emitting diode; a second transistor having a control electrode connected with the second conductive electrode of the first transistor; and a capacitor having one end connected with a data voltage terminal and having the other end connected with a first node, which is connected with a control electrode of the first transistor and with a first conductive electrode of the second transistor.

Another embodiment of the invention provides a light-emitting device that includes: a light-emitting diode; a first transistor having a first conductive electrode connected with a source voltage terminal and having a second conductive electrode connected with an input terminal of the light-emitting diode; a second transistor having a control electrode connected with the second conductive electrode of the first transistor; and a capacitor having one end connected with a data voltage terminal and having the other end connected with a first node, which is connected with a control electrode of the first transistor and with a first conductive electrode of the second transistor.

Yet another embodiment of the invention provides a display device that includes: a multiple number of light-emitting devices including light-emitting diodes; and a data driving unit configured to apply a data voltage to the multiple light-emitting devices, where each of the light-emitting devices includes a first transistor, a second transistor, and a capacitor, the first transistor has a first conductive electrode thereof connected with a source voltage terminal, the first transistor has a second conductive electrode thereof connected with an input terminal of the light-emitting diode, the first transistor has a control electrode thereof connected with the other end of the capacitor, the second transistor has a first conductive electrode thereof connected with the other end of the capacitor, the second transistor has a second conductive electrode thereof connected with a ground, the second transistor has a control electrode thereof connected with the second conductive electrode of the first transistor, the capacitor has one end thereof connected with the data driving unit to receive the data voltage, and the capacitor has the other end thereof further connected with the source voltage terminal.

An embodiment of the invention makes it possible to compensate for changes in the threshold voltage occurring due to the continuous gate bias in a driving transistor and deviations in electron mobility occurring due to normal processes in the driving transistor.

Also, an embodiment of the invention can prolong the lifespan of the light-emitting diodes.

DETAILED DESCRIPTION

Figure 1:
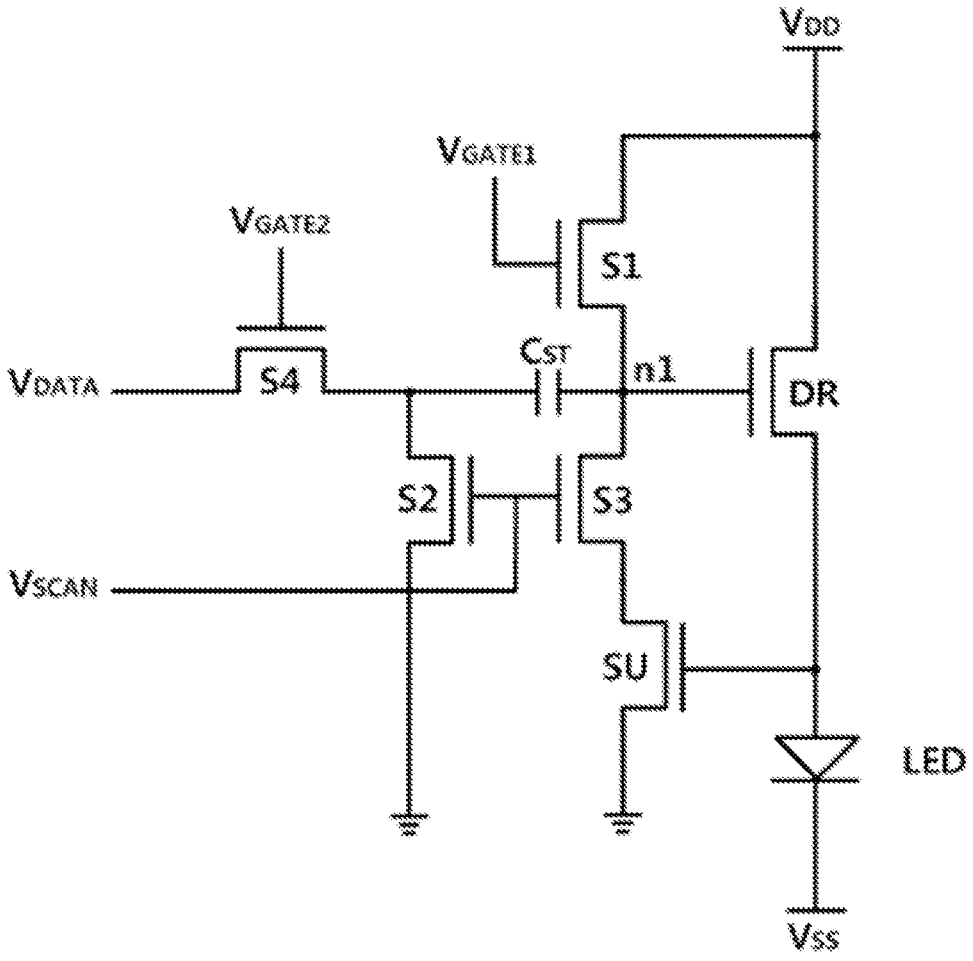
FIG. 1 illustrates the specific circuit composition of a device for driving a light-emitting diode according to an embodiment of the invention.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention.

While such terms as "first" and "second," etc., may be used to describe various components, such components must not be limited to the above terms. The above terms are used only to distinguish one component from another. Also, when a component is mentioned to be "coupled" or "connected" to another component, this may mean that it is directly coupled or connected to the other component, but it is to be understood that yet another component may exist in-between.

Certain embodiments of the invention are described below in more detail with reference to the accompanying drawings.

FIG. 1 illustrates the specific circuit composition of a device for driving a light-emitting diode according to an embodiment of the invention.

Referring to FIG. 1, the device for driving a light-emitting diode according to an embodiment of the invention may be a device that controls the driving of light-emitting diodes (LED) using a voltage-driven method and. The device may include a first transistor DR, a capacitor $C_{ST}$, and a second transistor SU, as well as four switching elements S1, S2, S3, S4 for controlling the connection relationships between the source voltage terminal $V_{DD}$, data voltage terminal $V_{DATA}$, first transistor DR, capacitor $C_{ST}$, and second transistor SU.

The first transistor DR may be an element for driving a light-emitting diode LED and may be a driving transistor for applying a source voltage $V_{DD}$ to the light-emitting diode LED. The capacitor $C_{ST}$ may be a storage capacitor for storing the voltage inputted to the control electrode of the first transistor DR. The second transistor SU may be a setup transistor for compensating for changes in the threshold voltage and deviations in electron mobility that occur in the first transistor DR.

According to an embodiment of the invention, at least one of the first transistor DR and the second transistor SU can be a thin-film transistor. For example, the thin-film transistor can be an amorphous silicon thin-film transistor, a polycrystalline silicon thin-film transistor, or an oxide thin-film transistor, as described above. In cases where the first transistor DR and the second transistor SU are thin-film transistors, the first conductive electrode, the second conductive electrode, and the control electrode of each transistor DR, SU can correspond to the drain electrode, the source electrode, and the gate electrode. Also, according to an embodiment of the invention, the light-emitting diode LED can be an organic light-emitting diode (OLED).

Looking at the connection relationships in more detail, the first conductive electrode of the first transistor DR may be connected with the source voltage terminal $V_{DD}$, the second conductive electrode of the first transistor DR may be connected with the input terminal of the light-emitting diode LED, and the control electrode of the first transistor DR may be connected with the other end of the capacitor $C_{ST}$ at the first node n1.

Also, the first conductive electrode of the second transistor SU may be connected with the other end of the capacitor $C_{ST}$ and with the control electrode of the first transistor DR at the first node n1 by way of the third switching element S3 (i.e. the third switching element S3 may have one end connected with the first node n1 and the other end connected with the first conductive electrode of the second transistor SU), the second conductive electrode of the second transistor SU may be connected with the ground, and the control electrode of the second transistor SU may be connected with the second conductive electrode of the first transistor DR and with the input terminal of the light-emitting diode LED.

Also, one end of the capacitor $C_{ST}$ may be connected with the ground by way of the second switching element S2 (i.e. the second switching element S2 may have one end connected with one end of the capacitor $C_{ST}$ and the other end connected with the ground) and at the same time may be connected with the data voltage terminal $V_{DATA}$ by way of the fourth switching element S4 (i.e. the fourth switching element S4 may have one end connected with the data voltage terminal $V_{DATA}$ and the other end connected with one end of the capacitor $C_{ST}$), while the other end of the capacitor $C_{ST}$ may be connected with the control electrode of the first transistor DR and with the first conductive electrode of the second transistor SU at the first node n1 as already described above.

Furthermore, the source voltage terminal $V_{DD}$ may be connected with the other end of the capacitor $C_{ST}$, the control electrode of the first transistor DR, and first conductive electrode of the second transistor SU at the first node n1 by way of the first switching element S1 (i.e. the first switching element S1 may have one end connected with the source voltage terminal $V_{DD}$ and the other end connected with the first node n1), and the output terminal of the light-emitting diode LED may be connected with $V_{SS}$ or the ground.

Also, the four switching elements S1, S2, S3, S4 can be arranged to include a transistor as illustrated in FIG. 1. In this case, the on/off states of the switching element S1, S2, S3, S4 can be controlled respectively by the voltages $V_{GATE1}$, $V_{GATE2}$, $V_{SCAN}$ inputted to the control electrode of the transistor.

A light-emitting diode driving device having the composition described above can be controlled in a divided manner with four time segments (a first time segment, a second time segment, a third time segment, and a fourth time segment) that are repeated according to a preset cycle. The operations of the light-emitting diode device are described below in more detail with reference to FIG. 2 through FIG. 6.

Figure 2:
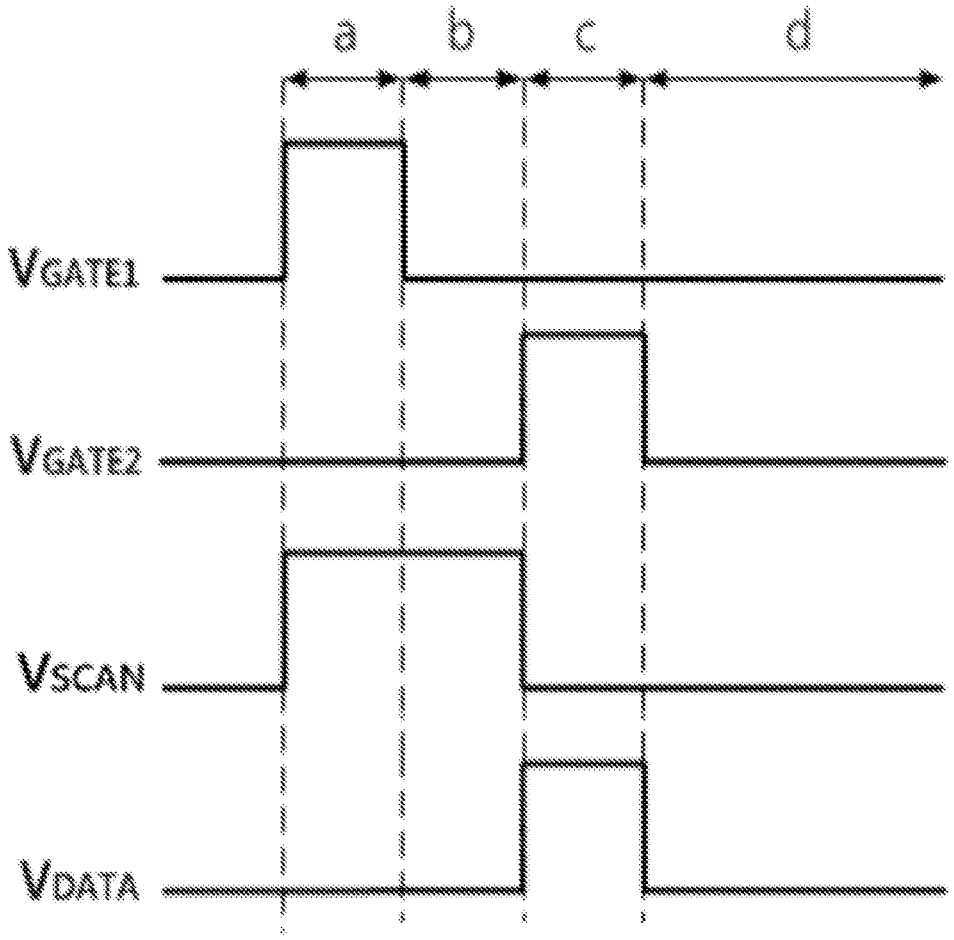
FIG. 2 illustrates the times at which each of the four switching elements S1, S2, S3, S4 included in a device for driving a light-emitting diode according to an embodiment of the invention is turned on/off and the times at which a data voltage $V_{DATA}$ is applied.
Figure 3:
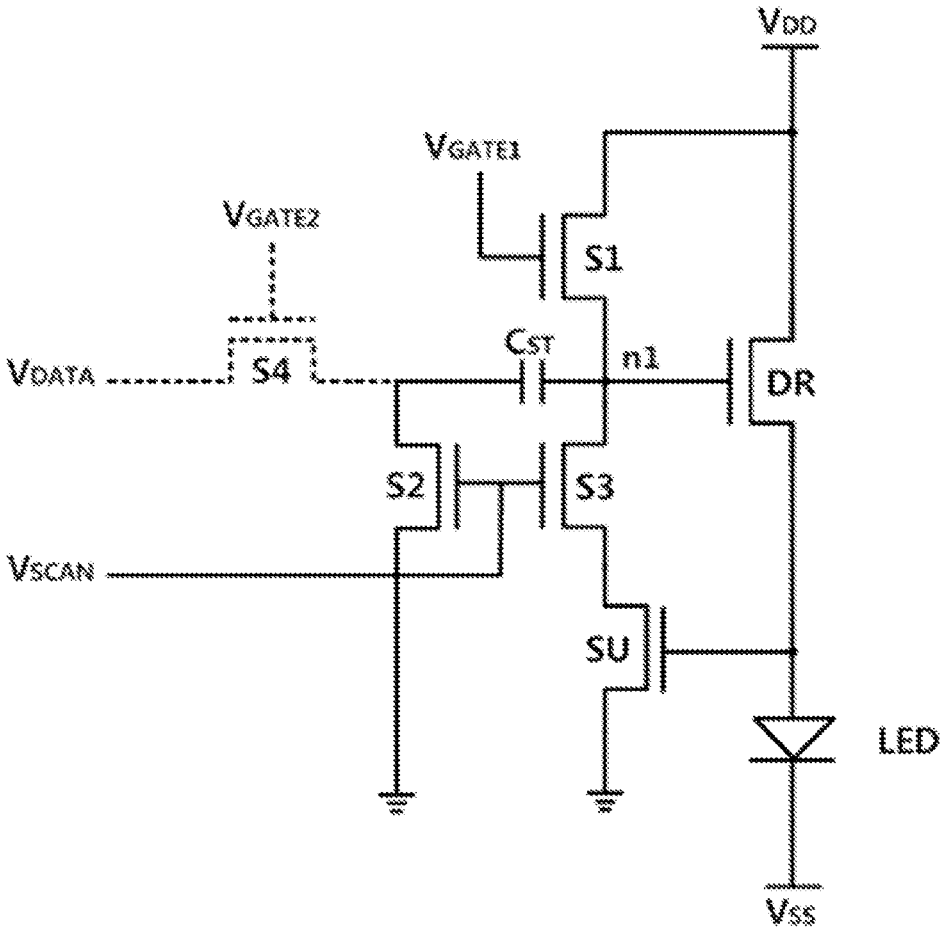
FIG. 3, FIG. 4, FIG. 5, and FIG. 6 each illustrate an equivalent circuit of the device for driving a light-emitting diode at each time segment.
Figure 4:
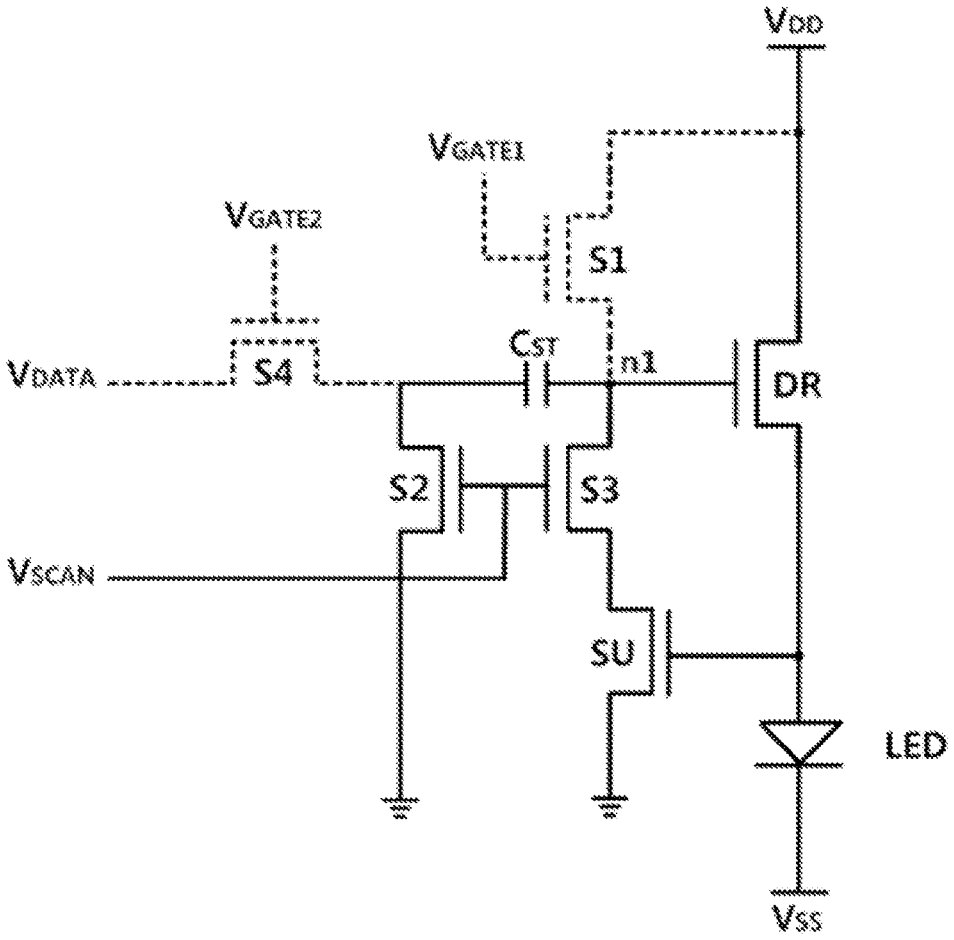
Figure 5:
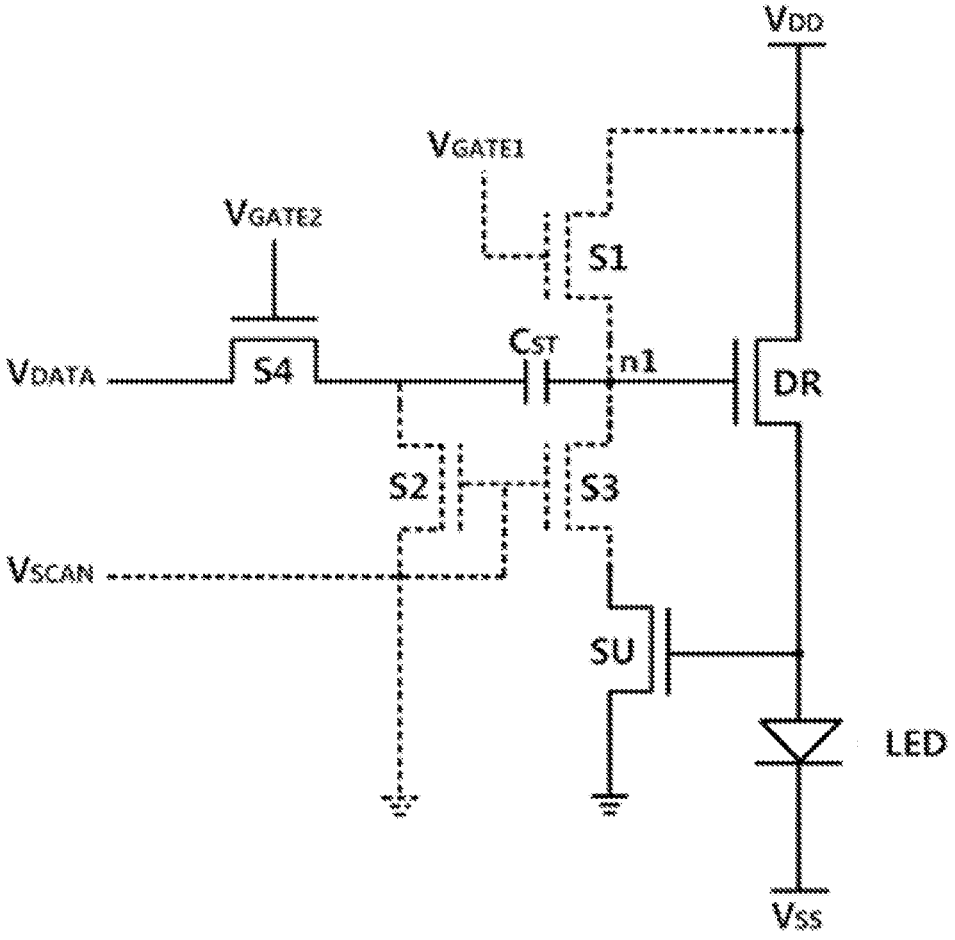
Figure 6:
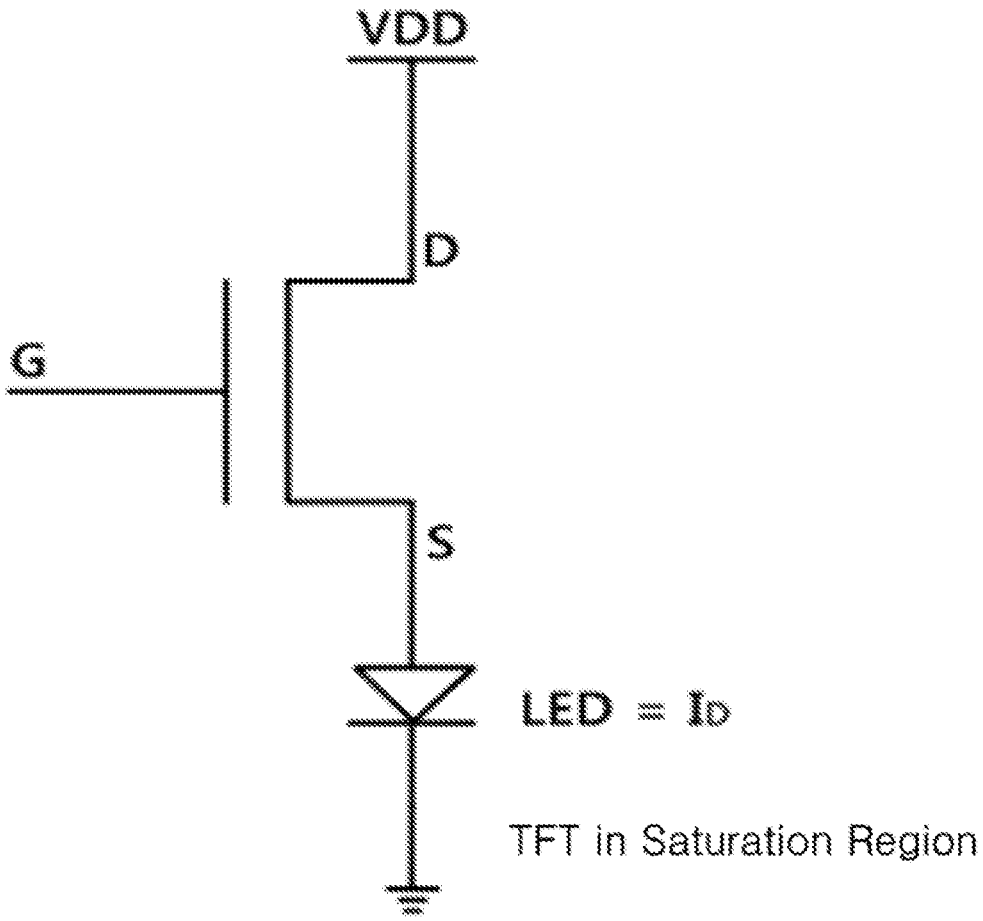

FIG. 2 illustrates the times at which each of the four switching elements S1, S2, S3, S4 included in a device for driving a light-emitting diode according to an embodiment of the invention is turned on/off and the times at which a data voltage $V_{DATA}$ is applied, while FIG. 3 to FIG. 6 each illustrate an equivalent circuit of the device for driving a light-emitting diode at each time segment.

First, referring to FIG. 2, the first switching element S1 may be in an on state only during the first time segment (a) and may be in an off state in the remaining time segments (see the graph for $V_{GATE1}$). Also, the second switching element S2 and third switching element S3 may be on during the first time segment (a) and the second time segment (b) and may be off during the third time segment (c) and the fourth time segment (d) (see the graph for $V_{SCAN}$). Also, the fourth switching element S4 may be on only during the third time segment (c) and may be off in the remaining time segments (see the graph for $V_{GATE2}$). Lastly, the data voltage may be applied only in the third time segment (c) (see the graph for $V_{DATA}$).

That is, the source voltage terminal $V_{DD}$ may supply a source voltage to the first node n1 in the first time segment (a), one end of the capacitor $C_{ST}$ may be connected with the ground in the first time segment (a) and the second time segment (b), the first node n1 may be connected with the first conductive electrode of the second transistor SU in the first time segment (a) and the second time segment (b), and the data voltage terminal $V_{DATA}$ may supply a data voltage $V_{DATA}$ to one end of the capacitor $C_{ST}$ in the third time segment (c).

The operations of the light-emitting diode driving device according to an embodiment of the invention are described below in more detail for each time segment.

First, in the first time segment (a), the first switching element S1, second switching element S2, and third switching element S3 may be in an on state, and the fourth switching element S4 may be in an off state. Thus, the light-emitting diode driving device may operate as the equivalent circuit illustrated in FIG. 3.

Here, since the first node n1 is connected with the source voltage terminal $V_{DD}$, a voltage $V_{DD}$ amounting to the source voltage may be stored (charged) at the control electrode of the first transistor DR, which is a driving element (i.e. at the first node n1). Thus, the capacitor $C_{ST}$ that was storing voltage during the previous frame may be initialized during the first time segment (a). As a result, the first transistor DR, which is a driving element, may operate, light may be emitted from the light-emitting diode LED, and the second transistor SU, which is a set-up element, may be driven during the first time segment (a).

Next, in the second time segment (b), the second switching element S2 and the third switching element S3 may be in an on state, and the first switching element S1 and the fourth switching element S4 may be in an off state. Thus, the light-emitting diode driving device may operate as the equivalent circuit illustrated in FIG. 4.

Here, since both ends of the capacitor $C_{ST}$ are connected with the ground, the capacitor $C_{ST}$ may discharge the stored voltage. However, since the first node n1, which corresponds to the other end of the capacitor $C_{ST}$, is connected with the ground by way of the second transistor SU, which is a set-up element, the discharging time of the capacitor $C_{ST}$ may be delayed compared to the case in which the first node n1 is connected with the ground directly. As a result, a voltage amounting to the threshold voltage of the second transistor SU may remain in the capacitor $C_{ST}$ after the completion of the second time segment (b).

The voltage thus remaining in the capacitor $C_{ST}$ may be applied to the control electrode of the first transistor DR, which is a driving element, and this may serve as a compensating voltage that compensates for changes in the threshold voltage of the first transistor DR. In this way, the changes in threshold voltage of the first transistor DR may be compensated for by the second transistor SU.

Also, the compensating voltage remaining in the capacitor $C_{ST}$ may be supplied by the second transistor SU, which is a set-up element turned on by the voltage of the second conductive electrode of the first transistor DR, a driving element. Therefore, the current flowing through the light-emitting diode LED is irrelevant to electron mobility, so that deviations in electron mobility at the first transistor DR may be compensated for. This is proved by Equation 1 shown below.

$$I_{LED} \propto e^{V_{DS}} \qquad \text{[Equation 1]}$$

$$V_{DS} = I_D \times R_{ON}$$

$$I_S \propto k = \mu C_{OX} \frac{W}{L},\ R_{ON} \propto \frac{1}{k} = \frac{1}{\mu C_{OX} W}$$

Equation 1 is applicable when the first transistor DR is a thin-film transistor and the voltage applied to the gate of the thin-film transistor in the saturation region is constant. $I_{LED}$ represents the current flowing to the light-emitting diode LED, $V_{DS}$ represents the voltage between the first conductive electrode (drain electrode) and the second conductive electrode (source electrode) of the first transistor DR, $I_D$ represents the current flowing to the first conductive electrode (drain electrode) of the first transistor, and $R_{ON}$ represents the equivalent resistance when the first transistor DR is on. Also, μ represents the electron mobility of the first transistor DR, $C_{ox}$ represents the capacitance per unit area of the capacitor formed by the gate-oxide-semiconductor, and W/L represents the aspect ratio of the first transistor DR.

Referring to Equation 1, $I_{LED}$ is proportional to $V_{DS}$, and $V_{DS}$ is expressed as a product of $I_D$ and $R_{ON}$. However, since μ (electron mobility) is present in both the numerator of $I_D$ and the denominator of $R_{ON}$, μ may be cancelled out in the product of the $I_D$ and $R_{ON}$, so that $V_{DS}$ and $I_{LED}$ become irrelevant to the electron mobility of the first transistor DR.

Thus, in the second time segment (b), the second transistor SU, which is a set-up element, makes it possible to compensate for the threshold voltage and for deviations in the electron mobility, and since a constant amount of voltage may thus be provided to the light-emitting diode LED, the lifespan of the light-emitting diode LED may be increased.

Continuing with the description, in third time segment (c), only the fourth switching element S4 may be on, and the first switching element S1, second switching element S2, and third switching element S3 may be off, while the data voltage ($V_{DATA}$) may be applied to the capacitor $C_{ST}$. Therefore, the light-emitting diode driving device may operate as the equivalent circuit illustrated in FIG. 5, and the data voltage ($V_{DATA}$) may be applied to the control electrode of the first transistor DR by way of the capacitor $C_{ST}$.

Here, due to the influence of the capacitor $C_{ST}$, a bootstrap effect may be created by which the data voltage ($V_{DATA}$) applied to the first node n1 that is connected with the control electrode (gate electrode) of the first transistor DR by way of the transistor forming the fourth switching element S4 can be transferred in a stable manner. Thus, the first node n1 may be charged by a voltage amounting to the sum of the compensating voltage remaining from the second time segment (b) and the data voltage ($V_{DATA}$).

Lastly, in the fourth time segment (d), all of the switching elements S1, S2, S3, S4 may be turned off. Thus, the light-emitting diode driving device may operate as the equivalent circuit illustrated in FIG. 6.

In this case, the first transistor DR, which is a driving element, may be turned on by the voltage stored (charged) in the capacitor $C_{ST}$, and as a result, a current may be applied to the light-emitting diode LED. Here, the current applied to the light-emitting diode LED can be expressed by Equation 2 shown below.

$$I_{LED} = \frac{1}{2}\mu C_{OX}\frac{W}{L}(V_{GS} - V_{TH})^2 \quad \text{[Equation 2]}$$

$$V_{GS} = V_G - V_S = V_{DATA} + V_{COMP},\ V_{COMP} = V_{TH}$$

$$\therefore I_{LED} = \frac{1}{2}\mu C_{OX}\frac{W}{L}(V_{DATA} + V_{TH} - V_{TH})^2 = \frac{1}{2}\mu C_{OX}\frac{W}{L}(V_{DATA})^2$$

Equation 2 is applicable when the first transistor DR is a thin-film transistor. $V_{GS}$ represents the voltage between the control electrode (gate electrode) and the second conductive electrode (source electrode) of the first transistor DR, $V_{TH}$ represents the threshold voltage of the first transistor DR, $V_G$ represents the voltage of the control electrode (gate electrode) of the first transistor DR, $V_S$ represents the voltage of the second conductive electrode (source electrode) of the first transistor DR, and $V_{COMP}$ represents the compensating voltage.

As set forth above, according to an embodiment of the invention, changes in the threshold voltage that occur in a driving transistor and deviations in electron mobility that occur during normal processes in a driving transistor can both be compensated for, ultimately increasing the lifespan of the light-emitting diode.

A device for driving a light-emitting diode according to an embodiment of the invention can be manufactured with a light-emitting diode to form a light-emitting device.

Figure 7:
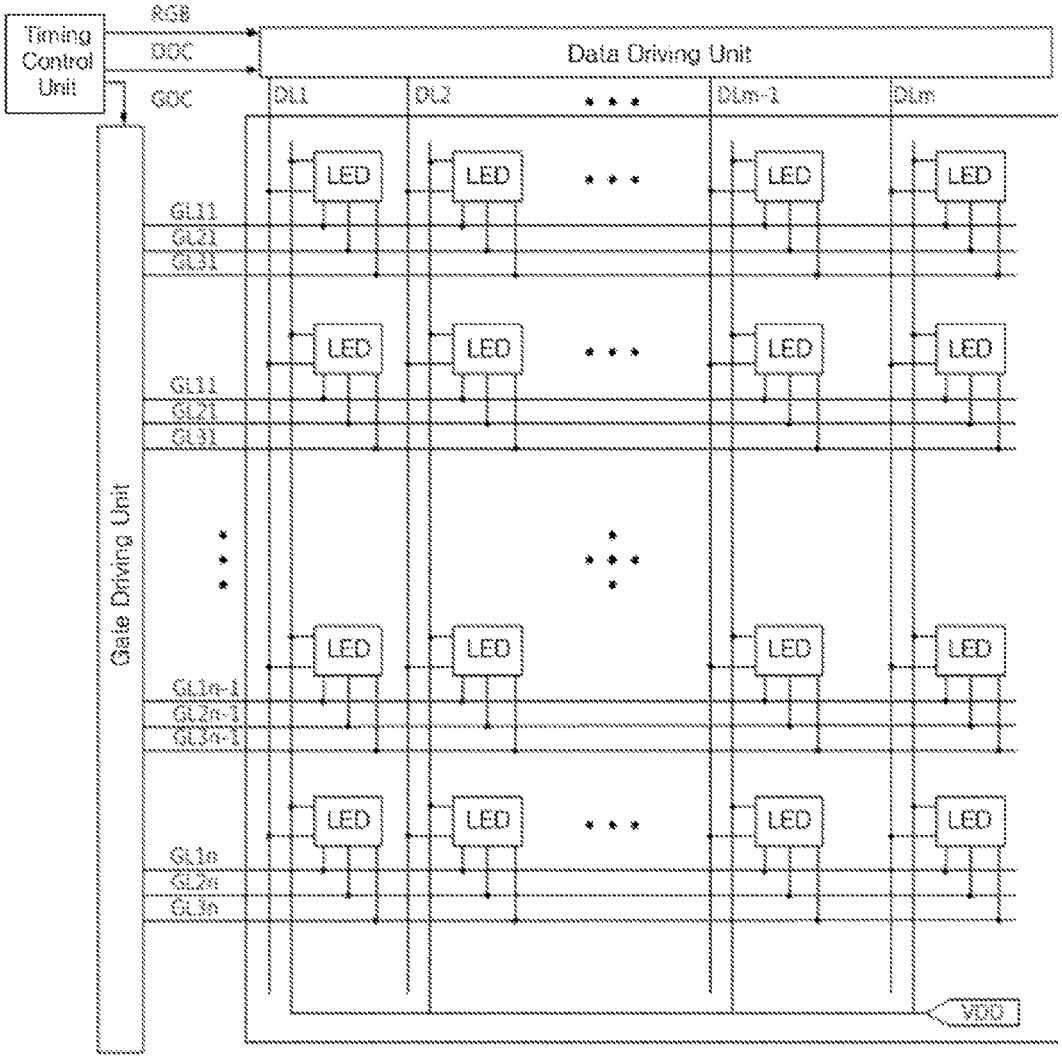
FIG. 7 schematically illustrates the composition of a display device of an active matrix form according to an embodiment of the invention.

Moreover, the light-emitting device can be applied to an active matrix circuit such as that illustrated in FIG. 7 to form a display device. In FIG. 7, the data driving unit may serve to apply a data voltage to the light-emitting device, and the gate driving unit may serve to apply a gate signal for controlling the switching of the switching elements S1, S2, S3, S4 within the light-emitting device.

While the present invention has been described above using particular examples, including specific components, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

The invention claimed is:

1. A device for driving a fight-emitting diode, the device comprising:

a first transistor having a first conductive electrode thereof connected with a source voltage terminal, having a second conductive electrode thereof connected with an input terminal of the light-emitting diode, and having a control electrode thereof connected with a first node;

a capacitor having one end thereof connected with the first node;

a first switching element having one end thereof connected with the source voltage terminal and another end thereof connected with the first node;

a second switching element having one end thereof connected with the one end of the capacitor and another end thereof connected with a ground;

a third switching element having one end thereof connected with the first node;

a fourth switching element having one end thereof connected with a data voltage terminal and another end thereof connected with the one end of the capacitor; and a second transistor having a control electrode thereof connected with the second conductive electrode of the first transistor, having a first conductive electrode thereof connected with another end of the third switching element, and having a second conductive electrode thereof connected with the ground, wherein the device is controlled in a divided manner for a first time segment, a second time segment, a third time segment, and a fourth time segment, the first switching element is turned on in the first time segment and turned off in the second time segment, the third time segment, and the fourth time segment, the second switching element and the third switching element are turned on in the first time segment and the second time segment and turned off in the third time segment and the fourth time segment, and the fourth switching element is turned on in the third time segment and turned off in the first time segment, the second time segment, and the fourth time segment.

2. The device for driving a light-emitting diode according to claim 1, wherein at least one of the first transistor and the second transistor is a thin-film transistor (TFT), and the light-emitting diode is an organic light-emitting diode (OLED).

3. A light-emitting device comprising:

a light-emitting diode;

a first transistor having a first conductive electrode thereof connected with a source voltage terminal, having a second conductive electrode thereof connected with an input terminal of the light-emitting diode, and having a control electrode thereof connected with a first node;

a capacitor having one end thereof connected with the first node;

a first switching element having one end thereof connected with the source voltage terminal and another end thereof connected with the first node;

a second switching element having one end thereof connected with the one end of the capacitor and another end thereof connected with a ground;

a third switching element having one end thereof connected with the first node;

a fourth switching element having one end thereof connected with a data voltage terminal and another end thereof connected with the one end of the capacitor; and a second transistor having a control electrode thereof connected with the second conductive electrode of the first transistor, having a first conductive electrode thereof connected with another end of the third switching element, and having a second conductive electrode thereof connected with the ground, wherein the light-emitting device is controlled in a divided manner for a first time segment, a second time segment, a third time segment, and a fourth time segment, the first switching element is turned on in the first time segment and turned off in the second time segment, the third time segment, and the fourth time segment, the second switching element and the third switching element are turned on in the first time segment and the second time segment and turned off in the third time segment and the fourth time segment, and the fourth switching element is turned on in the third time segment and turned off in the first time segment, the second time segment, and the fourth time segment.

4. A display device comprising:

a plurality of light-emitting devices including light-emitting diodes; and a data driving unit configured to apply a data voltage to the plurality of light-emitting devices, wherein each of the plurality of light-emitting devices comprises:

a first transistor having a first conductive electrode thereof connected with a source voltage terminal, having a second conductive electrode thereof connected with an input terminal of the light-emitting diode, and having a control electrode thereof connected with a first node, a capacitor having one end thereof connected with the first node, a first switching element having one end thereof connected with the source voltage terminal and another end thereof connected with the first node, a second switching element having one end thereof connected with the one end of the capacitor and another end thereof connected with a ground, a third switching element having one end thereof connected with the first node, a fourth switching element having one end thereof connected with the data driving unit and another end thereof connected with the one end of the capacitor, and a second transistor having a control electrode thereof connected with the second conductive electrode of the first transistor, having a first conductive electrode thereof connected with another end of the third switching element, and having a second conductive electrode thereof connected with the ground, each of the plurality of light-emitting devices is controlled in divided manner for a first time segment, a second time segment, a third time segment, and a fourth time segment, the first switching element is turned on in the first time segment and turned off in the second time segment, the third time segment, and the fourth time segment, the second switching element and the third switching element are turned on in the first time segment and the second time segment and turned off in the third time segment and the fourth time segment, and the fourth switching element is turned on in the third time segment and turned off in the first time segment, the second time segment, and the fourth time segment.

* * * * *